United States Patent [19]

Batoux et al.

[11] 4,017,306

[45] Apr. 12, 1977

[54] PROCESS FOR CONTINUOUS PRODUCTION OF PURE SODIUM

[75] Inventors: Bernard Batoux, Saint-Marcel; Albert Laurent-Atthalin, Annecy; Michel Salmon, Saint-Marcel, all of France

[73] Assignee: Metaux Speciaux S.A., Paris, France

[22] Filed: Dec. 30, 1974

[21] Appl. No.: 537,442

[30] Foreign Application Priority Data

Nov. 16, 1973 France ..... 73.40816

[52] U.S. Cl. ..... 75/66; 75/63

[51] Int. Cl.[2] ..... C22B 27/00

[58] Field of Search ..... 75/66, 63

[56] References Cited

UNITED STATES PATENTS

| | | | |
|---|---|---|---|
| 2,863,757 | 12/1958 | Altimier et al. | 75/66 |
| 3,508,907 | 4/1970 | Graff et al. | 75/66 |
| 3,854,933 | 12/1974 | Furukawa et al. | 75/66 |

*Primary Examiner*—M. J. Andrews

*Attorney, Agent, or Firm*—Dennison, Dennison, Meserole & Pollack

[57] ABSTRACT

The invention relates to a purification process by which sodium of extremely high purity, more especially with a low calcium content, can be obtained from commercial-grade sodium.

The process according to the invention essentially comprises continuously introducing a predetermined quantity of sodium peroxide into a stream of sodium, mixing and subsequently reacting this sodium peroxide with the sodium at a suitable temperature and finally separating the products of the reaction from the sodium by decantation and filtration.

The extremely high-purity sodium thus obtained satisfies in particular the requirements of the atomic industry for its use as a heat-carrying fluid in nuclear reactors of the "breeder" type.

4 Claims, 2 Drawing Figures

PROCESS FOR CONTINUOUS PRODUCTION OF PURE SODIUM

Figure 1:
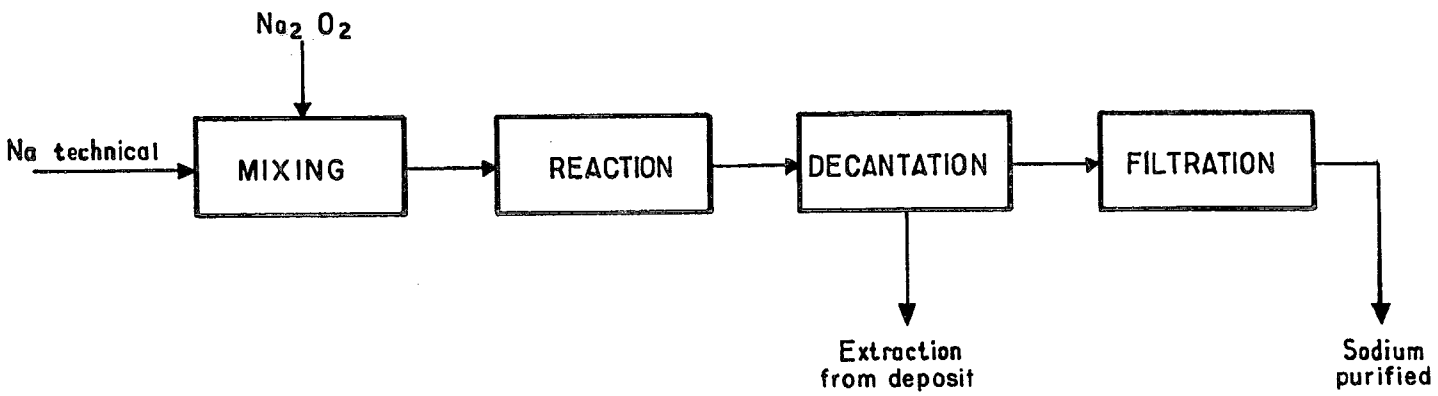

This invention relates to an industrial process for the production, from commercial-grade sodium, of extremely high-purity sodium for which there has recently been a very significant demand, especially in the atomic energy field. Thus, nuclear reactors of the breeder type generally use large quantities of sodium as heat-carrying fluid.

It has been found that the purity of commercial-grade sodium as produced on an industrial scale is not high enough for this particular application. It has to be freed from various impurities, more especially calcium present in quantities of from 300 to 500 ppm, and barium present in quantities of only a few tens of ppm. In order to satisfy nuclear specifications, such as those laid down by the French Atomic Energy Commission (Commissariat a l'Energie Atomique-C.E.A.), the calcium content has to be reduced to below 10 ppm and the barium content to below 5 ppm.

To obtain this result, it is known that the greater oxidizability of calcium in relation to sodium can be utilized by converting the calcium into lime with an adequate quantity of a suitable oxidizing agent. For example, French Pat. No. 1,214,176 in the name of E. I. duPont de Nemours and Co. claims the use of a mixture of nitrogen and oxygen which is bubbled through sodium at a temperature below 300° C, the oxides formed subsequently being physically separated.

Although this process gives positive results, it is relatively difficult to carry out. It involves appreciable losses of sodium through oxidation and does not incorporate any suitable method for separating the oxides of sodium and calcium formed from the sodium. Finally, it is not possible by this process systematically to obtain calcium contents below 10 ppm.

Substantial progress was made with the process described in French Pat. No. 1,484,647 in the name of the French Commissariat a l'Energie Atomique (C.E.A.). In order to eliminate the calcium present in commercial-grade sodium, this process uses an oxidizing agent, namely sodium peroxide, which is used under predetermined conditions in regard to quantity, temperature and time, the oxides formed being subsequently separated by filtration. This process effectively enables the calcium content of the sodium to be reduced below 10 ppm, and has been successfully used for the production of a few tens of metric tons of nuclear-grade sodium.

However, this process is attended by several disadvantages. First of all, it is extremely difficult to disperse the sodium peroxide uniformly throughout the batch of sodium to be purified despite the use of powerful agitators. Secondly, solid deposits rich in sodium peroxide are frequently formed on the walls of the reaction vessel, capable of causing dangerous local over-heating when the reaction is initiated. At the same time, the sodium peroxide content in other zones of the batch may become too low to completely oxidize the calcium present. This can result in a residual calcium content in the sodium produced which is too high for the applications envisaged. This disadvantage can be obviated to an extent by using a large excess of sodium peroxide which, in turn, increases the quantity of dangerous deposits and oxides to be separated, and substantially reduces the yield of sodium. In addition, after a few elementary treatments of a batch of commercial grade sodium with sodium peroxide, followed by separation of the oxides from the purified sodium by filtration, it is necessary completely to remove the deposits formed in the reaction vessel and on the filters. This involves laborious, arduous and even dangerous work which reduces productivity and which involves heavy losses of sodium and, hence, considerably increases the cost of the purified sodium. For these reasons, this process cannot be considered for the industrial production of the thousands of metric tons of nuclear-grade sodium required for high-output breeder reactors.

The process according to the present invention enables the disadvantages of the conventional processes discussed above to be obviated. Although based on the same principle as the batch process described in French Patent Specification 1,484,647, it differs radically from that process through an entirely new concept of application attributable to an original continuous process capable of providing, under economic conditions, the industrial quantities of very high-purity sodium required by the nuclear industry.

We have found that there is considerable advantage in dividing the process for purifying sodium into several successive but separate stages which are illustrated diagrammatically in FIG. 1. It can be seen that the continuous process comprises three stages: firstly, introducing sodium peroxide into and mixing it with the liquid sodium, secondly reacting the sodium peroxide preferentially with the calcium and barium present in the sodium, and thirdly separating the oxides formed during the reaction.

More specifically, the inventors have found a way of eliminating the disadvantages attending the prior art in regard to the mixing of solid sodium peroxide with liquid commercial-grade sodium by carrying it out continuously under conditions providing for extremely effective dispersion and uniform concentration. It has been found that it is possible in this way to reduce the optimum quantity of sodium peroxide to be added. This quantity which, according to French Patent No. 1,484,647, is preferably from 8 to 10 times the stoichiometric quantity corresponding to the reaction: $Ca + Na_2O_2 \rightarrow CaO + Na_2O$ can thus be reduced to only 2 to 4 times the stoichiometric quantity, i.e. approximately 4 to 8 times the quantity by weight of calcium in the sodium. It would of course also be possible in accordance with the invention to use larger quantities if necessary.

To obtain this result, a stream of liquid commercial-grade sodium flowing at a substantially constant rate is kept at a temperature between 100° and 150° C and preferably at a temperature between 110° and 120° C and has finely divided sodium peroxide continuously added to it. The optimum rate of flow of sodium peroxide is regulated in such a way that the content by weight of sodium peroxide reaches 4 to 8 times and preferably about 6 times the quantity by weight of calcium in the sodium. Experience has shown that a content by weight of sodium peroxide greater than 8 times and even as much as 20 times the content by weight of calcium in the sodium may be successfully used, but has the disadvantage of increasing the quantity of oxides formed and, hence, of reducing the yield of sodium. A content by weight of sodium peroxide of less than 4 times the quantity by weight of calcium in the sodium does not provide for complete elimination of the calcium, and the residual content of this element in the sodium increases to an extent which is greater, the smaller the excess of sodium peroxide becomes.

In order to obtain maximum effectiveness at the mixing stage, a state of turbulence has to be set up in the mixture so that the particles of sodium peroxide which are more dense than the sodium are kept in suspension, thus promoting their dispersion and wetting, whilst the formation of more or less compact agglomerates is avoided. A turbo-agitator for example can be used for this purpose.

After mixing, the stream of commercial-grade sodium containing the suspended sodium peroxide is heated to a temperature in the range from 200° to 300° C, and preferably to a temperature in the range from 220° to 250° C. Deposits of solid phase are preferably avoided by adequate agitation. These conditions promote preferential oxidation of the calcium and barium and any other highly oxidizable elements which may be present in the commercial-grade sodium, generally in much smaller quantities. After the reaction, the oxides of sodium present are separated from the sodium by any suitable method. In particular, it is possible to cool the mixture containing the suspended oxides to a temperature in the range from 100° to 150° C and preferably to a temperature in the range from 105° to 115° C, so as to minimize the solubility of the oxides, and then to decant the mixture so as to separate a large proportion of the oxides present and, finally, to filter the liquid sodium through a filter which is sufficiently fine to retain the greater part of the oxides which have remained in suspension in the form of fine particles.

Throughout this process, the sodium has to be protected against the action of air and moisture by using fluid-tight pipes and compartments and by protecting the surface of the liquid sodium by an atmosphere of a dry, inert gas such as nitrogen. The calcium content of the sodium thus treated by this continuous process is reduced to an extremely low level following separation of the oxides. It is systematically less than 10 ppm when the addition of sodium peroxide is of the order of 4 to 8 times or more the content by weight of calcium in the sodium. It is even possible to obtain in an entirely reproducible, regular manner a residual calcium content of less than 2 ppm. The barium content is reduced to below 5 ppm.

Figure 2:
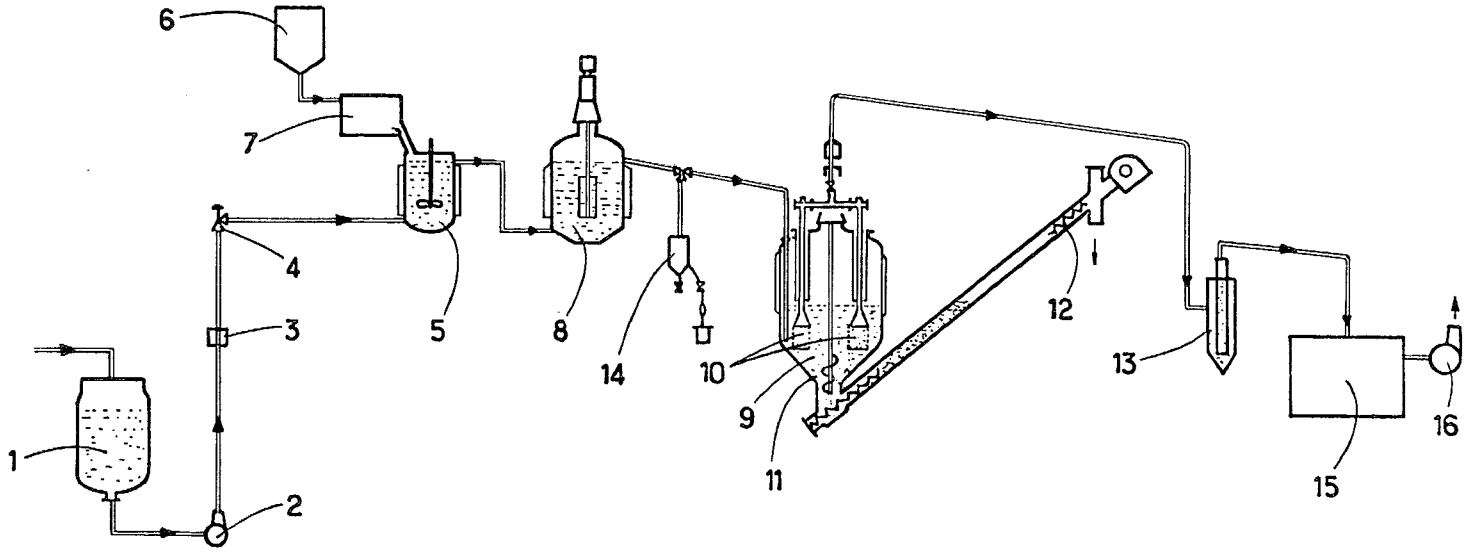

The advantages of the process which has just been described in general terms are presented in practical terms in the following example which describes only one embodiment of the invention:

FIG. 2 illustrates this embodiment: the fluid-tight reservoir 1 with a capacity of approximately 2 cubic meters, at the head of the installation is intended to accommodate the commercial-grade sodium to be purified. This commercial-grade sodium contains approximately 300 to 500 ppm of calcium and a few tens of ppm of barium. It is kept at a temperature around 120° C. A centrifugal pump 2 feeds the installation from this reservoir which is itself filled with commercial-grade sodium from an outside source by conventional means (not shown). The rate of flow is controlled by means of a flowmeter 3 and an adjustable valve 4. It is adjusted to approximately 400 kg/h. The sodium peroxide is added to the stream of sodium in an approximately 80 liter capacity mixer 5 provided with a high-speed stirrer. The sodium peroxide, in the form of 0.2 to 0.4 mm granules coming from a fluid-tight reservoir 6 is introduced by a continuous metering unit 7 in a quantity by weight adjusted to approximately 0.3% of the weight of the sodium. The temperature of the sodium in the mixer is regulated to between 110° and 130° C. The mixture thus formed passes continuously into an approximately 1.5 cubic meter capacity reactor 8, in which the sodium is heated to a temperature in the range from 210° to 230° C. The formation of deposits is prevented by an agitation system. At that temperature, the sodium peroxide reacts preferentially with the calcium, the barium and with any other highly oxidizable elements which may be present, the reaction being accompanied by the formation of oxides which remain substantially suspended in the agitated stream of sodium.

The stream of sodium containing a certain quantity of solid phases in suspension flows continuously into a decanter 9. This apparatus consists of a fluid-tight compartment with a conical base and a useful capacity of approximately 2 cubic meters. The temperature is regulated to cool the sodium and to keep it at a temperature between 105° and 115° C.

Two dip tubes provided with strainers 10 immersed in the sodium enable it to be withdrawn under suction by placing the storage container 15 under reduced pressure by means of a vacuum pump 16. The greater part of the solid particles suspended in the sodium coming from the mixer are deposited in the conical part of the decanter. A scraper 11 strips these deposits and entrains them towards the screw 12 which carries them upwards into a 45° chute and discharges them into a receiving container (not shown). This operation is carried out intermittently.

After passing through the strainers 10, the sodium passes through a filter 13 intended to retain the fine particles which have remained in suspension. The filtration temperature is in the range from about 105° to 115° C. The quality of the purified sodium is checked at the reactor outlet by means of a sampler 14 consisting of a 5 liter capacity reservoir, in which the sodium is cooled to between about 105° and 115° C, and of a filter similar to the filter 13. After filtration, the sample is solidified and analyzed to determine its calcium content. This monitoring process is essentially a production check.

After filtration through the filter 13, the sodium is received in a 30 cubic meter capacity storage tank 15.

The sodium is protected against the effect of air and moisture by a distribution network for dry nitrogen which fills all the empty spaces above the level of this metal throughout the entire installation. The sodium peroxide reservoir and the continuous metering system by which it is introduced into the sodium are also protected against the effect of air and moisture by dry nitrogen.

The installation which has just been described has an output of approximately 10 metric tons per day. The following Table shows the average results of a series of analyses carried out both on commercial-grade sodium and on the purified sodiumobtained from it. This Table also shows the requirements of the French Commissariat a l'Energie Atomique (C.E.A.), which, as can be seen, are largely satisfied.

TABLE 1

Contents expressed in parts per million (ppm)

| Elements | Initial Content in the commercial-grade sodium | Content in the purified sodium | C.E.A. Requirements |
|---|---|---|---|
| Calcium | 500 ppm | 2 | ≤ 10 |
| Chlorine | | 12 | ≤ 20 |

TABLE 1-continued

| Contents expressed in parts per million (ppm) Elements | Initial Content in the commercial-grade sodium | Content in the purified sodium | C.E.A. Requirements |
|---|---|---|---|
| Sulphur | | 13 | ≤ 30 |
| Carbon | | 12 | ≤ 50 |
| Silver | | <1 | ≤ 20 |
| Boron | | <5 | ≤ 5 |
| Barium | | <3 | ≤ 5 |
| Lithium | | <1 | ≤ 20 |

Further advantages of the continuous process according to the invention become apparent when the conditions under which the installation which has just been described are run are compared with those of an installation operated in accordance with the batch process disclosed in French Pat. No. 1,484,647.

This conventional installation comprises a reactor capable of producing approximately 4 metric tons of sodium by working at the rate of one operation per day, i.e. approximately 80 metric tons per month at a rate of 5 operations per week. It was used for producing a batch of 115 metric tons of nuclear-grade purity.

The continuous installation described earlier on was used for producing 140 metric tons per month of nuclear-grade sodium, the total output amounting to 1420 metric tons.

TABLE 2

| | Batch Process | Process according to the invention |
|---|---|---|
| Capacity of installation | 4 T (1) per day | 7 T per day (2) |
| Quantity of nuclear-grade sodium produced | 115 T | 140 T (3) |
| Production period | 4 months | 1 month |
| Weight of commercial-grade sodium used | 150 T | 141 T |
| Weight of sodium eliminated | 12 T | 1.4 T |
| Weight of impure sodium for subsequent recycling | 23 T | 0.0 T |
| Weight of sodium peroxide used | 900 Kg | 338 Kg |

(1) T = metric ton
(2) this capacity was subsequently increased to 10 metric tons per day following minor modifications
(3) in both cases, the installations were run for 5 days per week.

It can be seen from this Table that treatment by the batch process incurred a sodium loss of 12 tons and produced another 23 metric tons of excessively impure, non-usable sodium. In addition, the consumption of sodium peroxide reaches 900 kg, i.e. substantially 8 times the stoichiometric quantity corresponding to elimination of the calcium and barium present in the commercial-grade sodium.

The sodium losses are explained by the fact that it was necessary to carry out in the reactor 47 operations on 34 batches of commercial-grade sodium each weighing 4.4 metric tons, 9 of which had to be subjected to two successive purification treatments, whilst another 2 had to be subjected to 3 successive purification treatments to obtain the required degree of purity.

In addition, the very large excess of sodium peroxide introduced promoted the formation of crusts and more or less solid sediments retaining a large proportion of sodium which had to be eliminated. These sediments were difficult to handle because their high concentration of sodium peroxide involved risks of inflammation and even explosion.

By contrast, the sodium treated by the continuous process according to the invention gave a sodium satisfying nuclear requirements directly, i.e. without any need for retreatment. The production rate of 7 metric tons per day corresponded to the receiving capacity of the consumer.

The embodiment of the process according to the invention which has just been described and the comparison made with the performances of the batch process, show very clearly that the continuous process according to the invention not only has very significant advantages in regard to productivity, it also gives the product with a higher degree of purity than that obtained by the batch process. The reduction in the limit contents of calcium and barium satisfies the increased requirements of such consumers as the Commissariat a l'Energie Atomique (limit barium content reduced from 10 to 5 ppm; Cl, S, C, Ag and Li contents limited to the values given in Table 1).

Surprisingly, this result is obtained at the expense of a loss of commercial-grade sodium of only 1% of the quantity used which is substantially negligible. One of the reasons explaining this very minimal loss is the limit of the quantity of $Na_2O_2$ introduced during the 3 times the theoretically necessary quantity, i.e. about 6 times the concentration by weight of the calcium in the commercial-grade sodium.

Finally, the qualitative and quantitative performances of the continuous process are entirely reproducible at a level of industrial production in excess of 100 metric tons per month, whilst the batch process gives extremely irregular results and is incapable of producing large quantities in a reliable manner, even if the quality factor is disregarded to a certain extent.

We claim:

1. A purification process for continuously producing extremely pure, nuclear-grade sodium from commercial-grade sodium containing calcium and barium impurities consisting essentially of the following stages, carried out in the absence of air and moisture:

a. continuously introducing sodium peroxide in a finely divided form into a stream of liquid commercial-grade sodium flowing at a substantially constant rate and at a temperature of between 110° and 120° C, the introduction of the sodium peroxide being continuously metered in a quantity by weight adjusted to between 2 to 8 times the quantity by weight of calcium in the commercial-grade sodium;

b. continuously mixing the sodium peroxide and commercial-grade sodium in a mixing zone at a temperature of between 110° and 130° C by vigorous stirring which enables the particles of sodium peroxide to be wetted by the commercial-grade sodium and to thus suspend and uniformly disperse the particles in the commercial-grade sodium;

c. continuously passing the mixture thus formed to a reaction zone at a temperature in the range from 210° to 230° C, the mixture being subjected to stirring of sufficient intensity to avoid the formation of any appreciable deposits in the mixing and reaction zones, the reaction being accompanied by the formation of calcium and barium oxides which remain substantially suspended in the agitated stream of commercial-grade sodium;

d. continuously flowing the aforesaid reaction mixture to a decantation zone kept at a cooling temperature of between 105° and 115° C;

e. separating the greater part of the suspended particles by decantation;

f. retaining the fine particles remaining in the suspension by filtration at about 105° to 115° C; and g. recovering from the filtration step a purified sodium containing less than 10 ppm of calcium and less than 5 ppm of barium.

2. A process as claimed in claim 1 wherein the purified sodium contains about 2 ppm of calcium and less than 3 ppm of barium.

3. A process as claimed in claim 1, wherein the input by weight of sodium peroxide is approximately 6 times the quantity by weight of calcium present in the sodium.

4. A process as claimed in claim 1 wherein the rate of flow of commercial-grade sodium is adjusted to approximately 400 kg/h.

* * * * *